US006038908A

United States Patent [19]

Kinoshita

[11] Patent Number: 6,038,908

[45] Date of Patent: Mar. 21, 2000

[54] BENDING DIE HAVING ROTARY DIE

[75] Inventor: Tadatoshi Kinoshita, Tokyo, Japan

[73] Assignee: Yourbusiness Co., Ltd., Tokyo, Japan

[21] Appl. No.: 09/206,877

[22] Filed: Dec. 8, 1998

[51] Int. Cl.[7] ..... B21D 5/04

[52] U.S. Cl. ..... 72/315; 72/313

[58] Field of Search ..... 72/312–315, 319, 72/420, 396, 387

[56] References Cited

U.S. PATENT DOCUMENTS

| | | | |
|---|---|---|---|
| Re. 31,938 | 7/1985 | Klukow | 72/319 |
| 1,030,259 | 6/1912 | Wells | 72/319 |
| 2,306,595 | 12/1942 | Crowell | 72/319 |
| 5,341,669 | 8/1994 | Katz | 72/387 |
| 5,347,838 | 9/1994 | Matsuoka | 72/313 |
| 5,404,742 | 4/1995 | Wilson | 72/319 |
| 5,746,082 | 5/1998 | Matsuoka | 72/313 |
| 5,784,916 | 7/1998 | Matsuoka | 72/313 |

FOREIGN PATENT DOCUMENTS

| | | | |
|---|---|---|---|
| 197318 | 11/1984 | Japan | 72/313 |

*Primary Examiner*—Daniel C. Crane

*Attorney, Agent, or Firm*—Andrus, Sceales, Starke & Sawall

[57] ABSTRACT

This invention is comprised of a lower die having a groove-like cavity formed at its upper surface; a rotary die supported in the cavity of the lower die at both ends thereof by a shaft and rotatably stored in it; an upper die arranged above the rotary die; and a driving device for rotating said rotary die in a downward direction after the upper die is opened and for retracting it. The cavity is formed with some protrusion steps at its inner circumferential surface for use in supporting the rotary die when pressed. The rotary die is formed with a forming part for gathering and bending a metallic plate at its upper surface to be extended in a longitudinal direction of the rotary die. The gathering and bending blade to be fitted to the forming part of the rotary die is formed at the upper die. In the case of the present invention, the aforesaid rotary die is supported at the protrusion steps when pressed while the outer edge of the forming part is being abutted against the upper edge of the lower die and after pressing operation, it is rotated in a downward direction by the driving device.

9 Claims, 6 Drawing Sheets

BENDING DIE HAVING ROTARY DIE

BACKGROUND OF THE INVENTION

1. Field of the Invention

This invention relates to a die for bending and machining a metallic plate, and more particularly a bending die having a rotary die.

2. Description of the Prior Art

As this kind of prior art bending die, there is provided an invention described in the gazette of U.S. Pat. No. 5,341,669, for example. This prior art product is formed to have a rotary bending head, a saddle block having a bearing surface and a retaining key for holding the aforesaid head and a member for returning the aforesaid head or the like.

The aforesaid prior art product is constructed such that the rotary bending head is rotated while it is slidably contacted with the bearing surface of the saddle block. Accordingly, in the case of the prior art product, the outer circumferential surface or the bearing surface of the rotary bending head had to be machined in a quite high accuracy. Because if these locations show a poor machining accuracy, the rotary bending head is not rotated smoothly, resulting in that this may cause a trouble in operation.

As a result, the prior art product had a problem that it took much time to machine the outer circumferential surface of the rotary bending head or the bearing surface of the saddle block and needed a high machining cost.

In addition, as shown in FIGS. 5 and 6, it is desirable that this kind of bending die is formed such that a contact point K (hereinafter called as a dividing point) between the upper edge 1*b* of the lower die 1 and the outer edge 5*a* of the formed part 5 formed at the rotary die 3 can be properly selected at the most suitable location in response to a product design.

Because if this dividing point may not be freely changed, it sometimes occurs that the products such as a fender or a pillar in an automobile having a curved surface or a bulged-out portion, for example, can not be pressed in a neat manner strictly in accordance with designs of the curved surface or bulged-out portion.

However, the prior art product was constructed such that the rotary bending head is directly supported by the saddle block. Accordingly, in the case of the prior art product, since the rotary bending head was formed into a column-like shape, if the dividing point was selected to exceed the diameter of the dividing point, the rotary bending head could not be rotated smoothly and the dividing point had to be selected usually at the position of the same distance from the center of the head over a longitudinal direction of the rotary bending head. As a result, in the case of this kind of prior art bending die, it showed a problem that the products having a curved surface or a bulged-out portion such as a fender or a pillar in an automobile could not be pressed in an accurate manner strictly in accordance with their design.

SUMMARY OF THE INVENTION

In the case of the present invention, the groove-like cavity is formed at the upper surface of the lower die. The rotary die supported by a shaft at its both ends is rotatably stored in the cavity. The upper die is arranged above the rotary die. In the case of the present invention, there is provided a driving device for rotating the rotary die in a downward direction and retracting it after the upper die is opened.

The cavity at the aforesaid lower die is formed with the protrusion steps for supporting the rotary die when pressed at its inner circumferential surface.

The aforesaid rotary die has at its upper surface a forming part for gathering and bending a metallic plate to be extended in a longitudinal direction of the rotary die.

In addition, the present invention is made such that the aforesaid upper die is formed with a gathering and bending blade to be fitted to the forming part of the rotary die.

Then, in the case of the present invention, the aforesaid rotary die is supported at the protrusion steps while the outer edge of the forming part is being abutted against the upper edge of the lower die when pressed, and after pressing operation, it is rotated in a downward direction by the driving device.

As described above, the present invention is made such that the rotary die is rotatably supported at both end shafts and the die is supported by the protrusion steps when pressed. Accordingly, the present invention is satisfactory operated such that the inner circumferential surface of the cavity at the lower die or the outer circumferential surface of the rotary die corresponding to the inner circumferential surface is linearly machine. As a result, since a curved surface machining for the bearing surface or the like can be saved in the present invention as compared with the prior art product, the rotary die or the upper die can be manufactured easily, rapidly and in a less-expensive manner.

In addition, as described above, since the present invention has a structure in which the rotary die is supported by the protrusion steps, it is not necessary to form the rotary die into the column shape and its outer shape can be freely formed.

Accordingly, in the case of the present invention, even if the dividing point (refer to the reference sign K in FIGS. 5 and 6) is selected to have a different distance from the center over a longitudinal direction of the rotary die, no trouble occurs at a rotating operation of the rotary die. As a result, in the case of the present invention, it is possible to select the dividing point at the most suitable position in compliance with the product design, so that even if the design for the products having curved surface or bulged-out part such as fender or pillar in the automobile, the present invention may easily be adapted for them.

DESCRIPTION OF THE PREFERRED EMBODIMENT

Referring now to the accompanying drawings, one preferred embodiment of the present invention will be described as follows.

Figure 1:
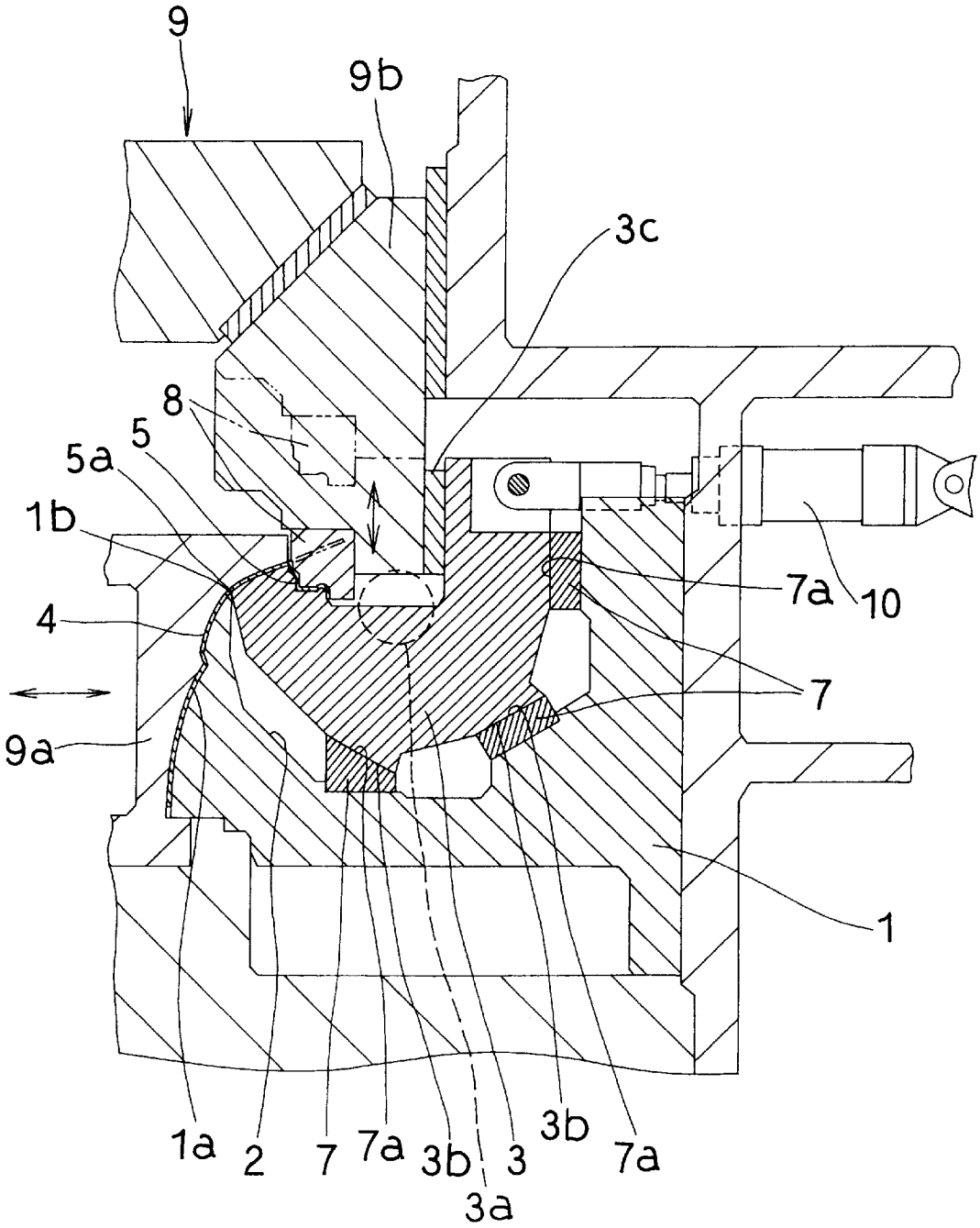
FIG. 1 is a longitudinal section for showing a substantial part to indicate one preferred embodiment of a bending die of the present invention.

In FIG. 1, reference numeral 1 denotes a lower die. Reference numeral 2 denotes a groove-like cavity formed at the upper surface of the lower die 1. The upper part 1*a* of the lower die 1 is formed into a forming surface. Reference numeral 1*b* denotes an upper edge of the lower die 1.

Reference numeral 3 denotes a rotary die which is rotatably stored in the cavity 2. This rotary die 3 is supported by a shaft 3*a* at both ends. Accordingly, in the case of the present invention, since the rotary die 3 is not slidingly contacted with the cavity 2, it is not necessary to feed oil at both sliding contact surfaces as found in the prior art product.

Reference numeral 4 denotes a metallic plate acting as a machined product. The upper surface of the rotary die 3 is formed with a forming part 5 for use in gathering and bending this metallic plate 4 which is extended in a longitudinal direction of the rotary die 3.

Figure 3:
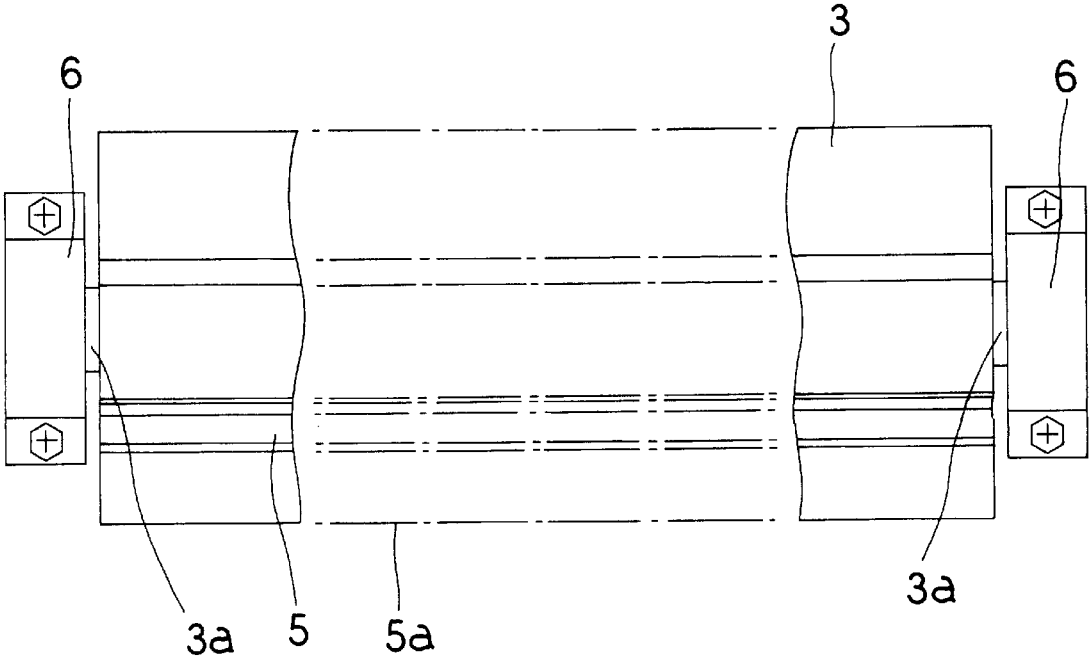
FIG. 3 is a top plan view for showing a substantial part with a rotary die being partially cut away.
Figure 4:
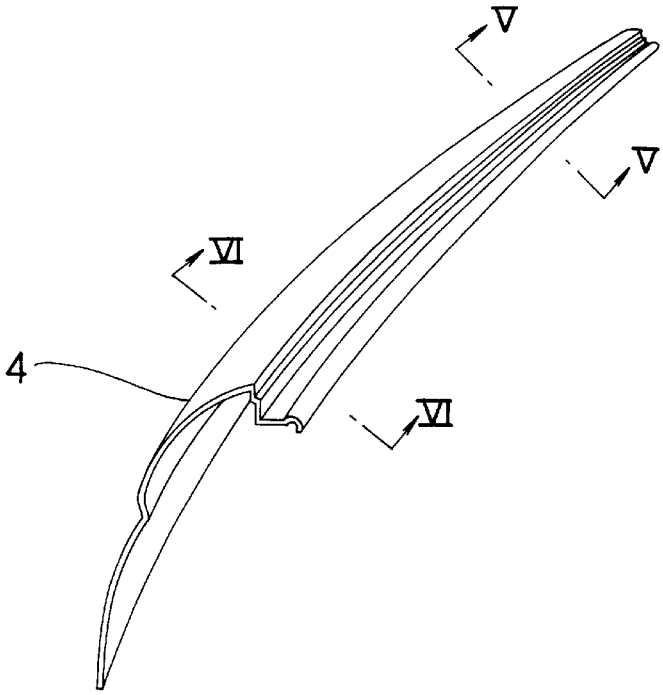
FIG. 4 is a perspective view for showing a formed product.
Figure 5:
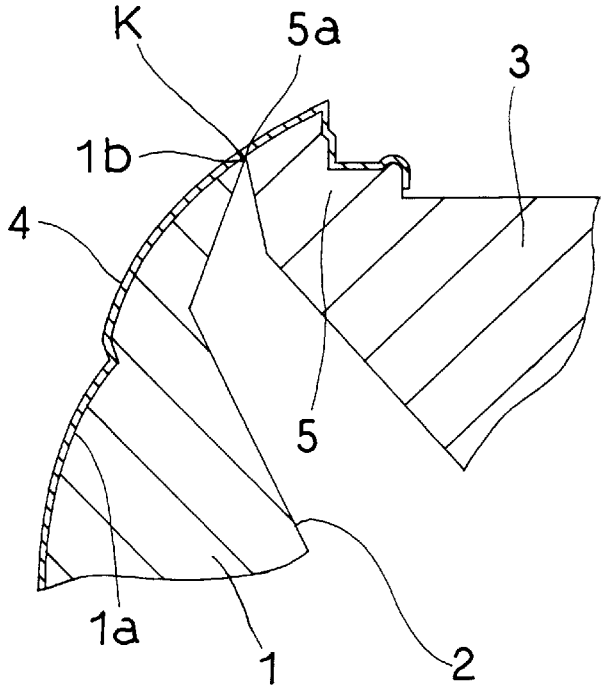
FIG. 5 is an enlarged section for showing a substantial part of the bending die to illustrate a dividing point taken along a line V—V of FIG. 4.
Figure 6:
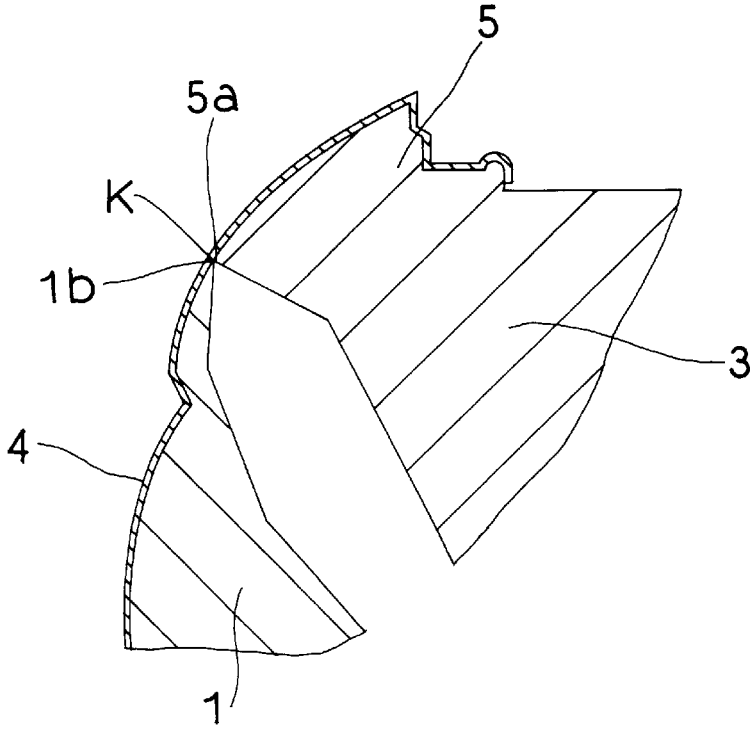
FIG. 6 is an enlarged section for showing a substantial part of the bending die to illustrate a dividing point taken along a line VI—VI of FIG. 4.

In FIG. 3, reference numeral 6 denotes bearings arranged at both ends of the rotary die 3. The bearings 6 in this preferred embodiment are composed of roller bearings to support the shaft 3*a* of the rotary die 3.

Reference numeral 7 denotes protrusion steps for use in supporting the rotary die 3 during pressing operation. The protrusion steps 7 in this preferred embodiment are formed at the inner circumferential surface of the cavity 2 while they are continuous in their longitudinal direction. As shown in FIG. 1, the protrusion steps 7 in this preferred embodiment are formed at a position opposing against a gathering and bending blade 8 formed at the upper die 9, a position opposing against a rear surface of the rotary die 3 and an intermediate position between both positions.

The aforesaid protrusion steps 7 in this preferred embodiment are formed in separate from the lower die 1 by cutting a steel material and then the steps 7 are fixed to the cavity 2 by bolts and nuts. In this preferred embodiment, all the receiving surfaces 7*a* of the protrusion steps 7 are formed into flat shape. Accordingly, the outer circumferential surface position 3*b* of the rotary die 3 abutting against the receiving surface 7*a* is formed into a flat surface in compliance with a gradient of the receiving surface 7*a*.

The upper die 9 is arranged above the rotary die 3. This upper die 9 in this preferred embodiment is formed to be provided with a pressing pat 9*a* advanced or retracted in a lateral direction against the upper part 1*a* of the lower die 1 and with a punch 9*b* ascended or descended by a cam mechanism in cooperation with this pressing pat 9*a*. The lower part of the punch 9*b* is formed with a gathering and bending blade 8 fitted to the forming part 5 of the rotary die 3. In FIG. 1 or the like, reference numeral 3*c* denotes a plate for guiding the punch 9*b* in an upward or a downward direction. This plate 3*c* is fixed to the rotary die 3 in a vertical orientation.

Reference numeral 10 denotes a driving device for use in rotating the rotary die 3 in a downward direction and retracting it after the upper die 9 is opened. The driving device 10 in this preferred embodiment is constituted by an air cylinder. The aforesaid rotary die 3 is supported at the protrusion step 7 during a pressing operation while an outer edge 5*a* of the forming part 5 is being abutted against the upper edge 1*b* of the lower die 1 and after pressing operation, it is rotated in a downward direction by the driving device 10.

Action of the present invention will be described as follows.

At first, a metallic plate 4 before machining is set to the upper part 1*a* of the lower die 1. Then, in FIG. 2, a rod of the air cylinder acting as the driving device 10 is retracted, thereby the rotary die 3 is rotated in a clockwise direction and contacted with the upper edge 1*b* of the lower die 1. As shown in FIG. 1, the outer circumferential surface position 3*b* of the rotary die 3 is abutted against the receiving surface 7*a* of the protrusion step 7 and the rotary die 3 is supported at the lower die 1 through the protrusion step 7.

Then, as shown in FIG. 1, the upper die 9 descends and the gathering and bending blade 8 gathers and bends the metallic plate 4. In the case of the preferred embodiment, more practically, the pressing pat 9*a* acting as the upper die 9 at first advances toward the upper part 1*a* of the lower die 1 to depress the metallic plate 4. Then, the punch 9*b* cooperating with the depressing pat 9*a* descends and the metallic plate 4 is gathered and bent by the gathering and bending blade 8. In the case of the present invention, a pressing pressure applied to the rotary die 3 in this case is received by the lower die 1 through the protrusion step 7.

Figure 2:
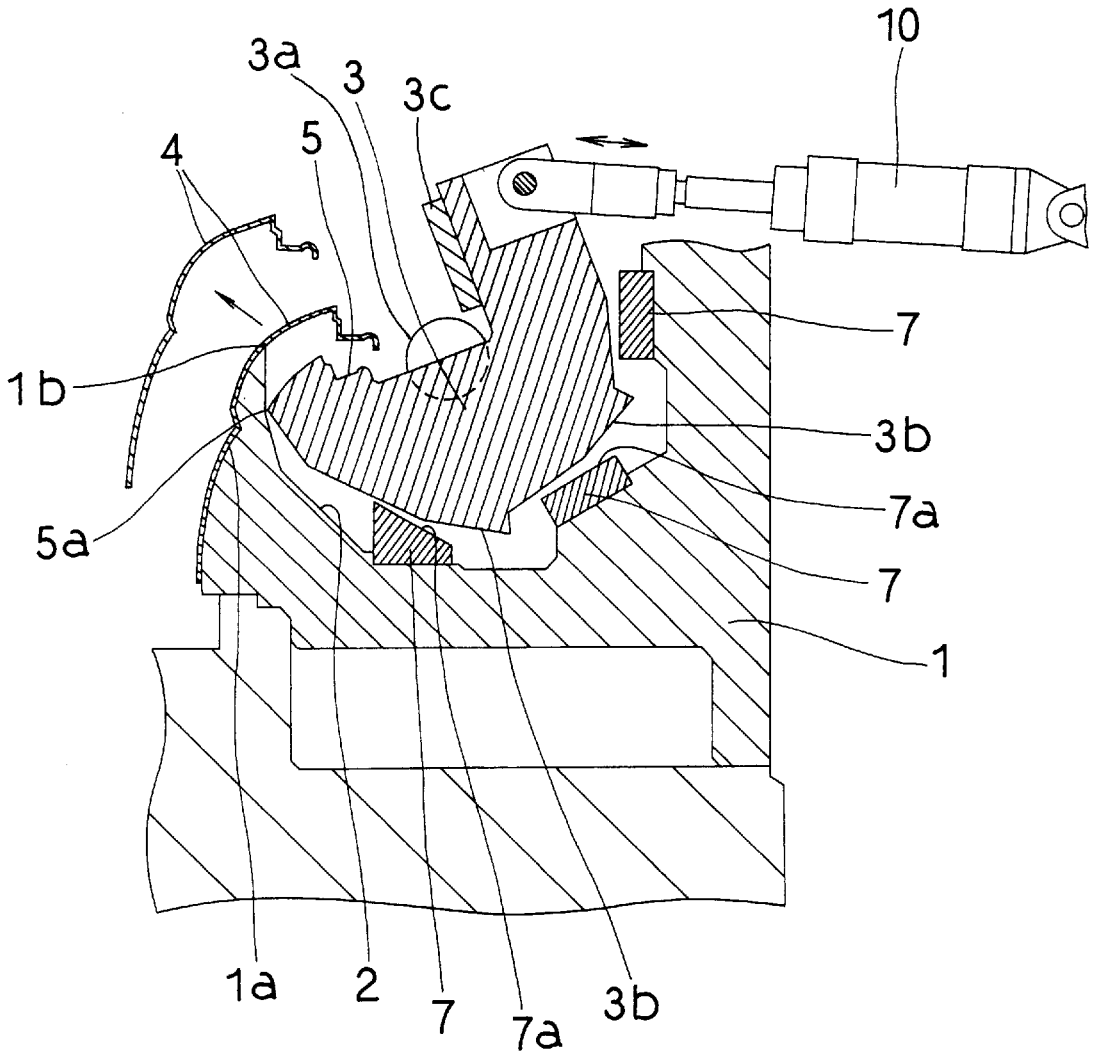
FIG. 2 is a longitudinal section for showing a substantial part to illustrate an action of the bending die.

Then, upon completion of this pressing operation, the upper die 9 ascends and the depressing pat 9*a* and the punch 9*b* are moved away from the lower die 1. Then, the driving device 10 receives a signal from a sensor for detecting the ascending operation of the upper die 9 and starts its operation, rotates the rotary die 3 in a downward direction and retracts it. In the case of this preferred embodiment, more practically as shown in FIG. 2, the rod of the air cylinder acting as the driving device 10 is extended to cause the rotary die 3 to be rotated in a counter-clockwise direction. As a result, as shown in this figure, the forming part 5 of the rotary die 3 is pulled away from the metallic plate 4, resulting in that the formed metallic plate 4 can be removed from the die. In this case, the outer circumferential surface position 3*b* of the rotary die 3 is arranged while the engaged state with the protrusion step 7 is being released and kept in its released condition.

Figure 7:
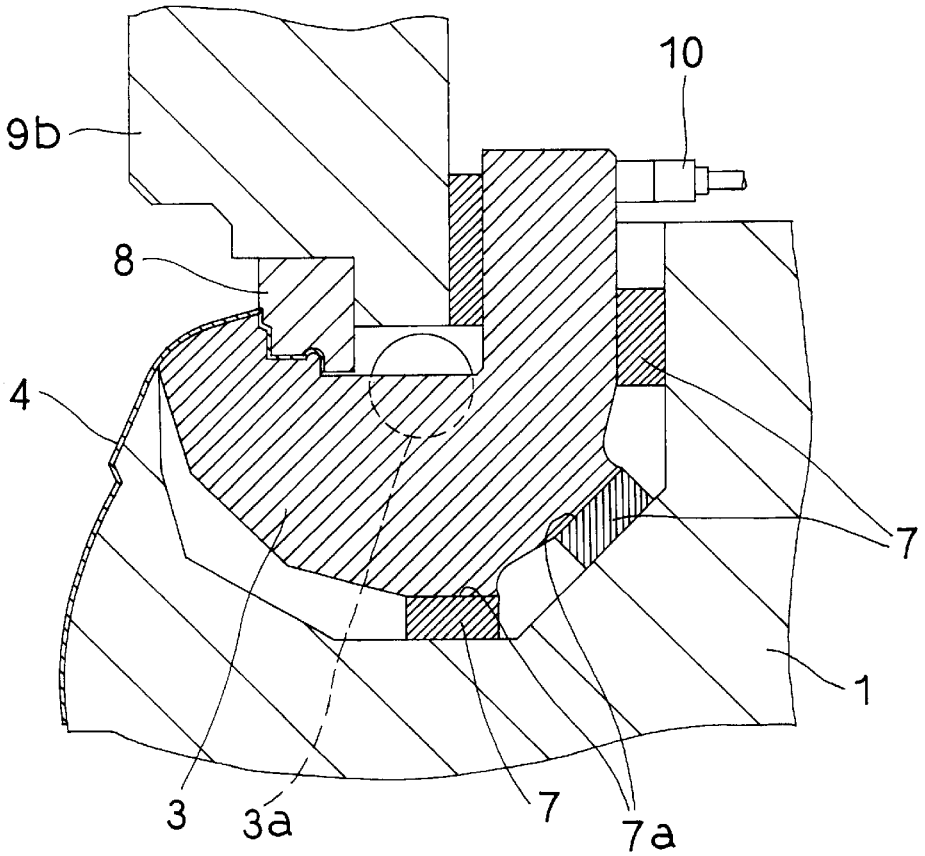
FIG. 7 is a longitudinal section for showing a substantial part to indicate another preferred embodiment about an arranging position and a shape of a protrusion step part.
Figure 8:
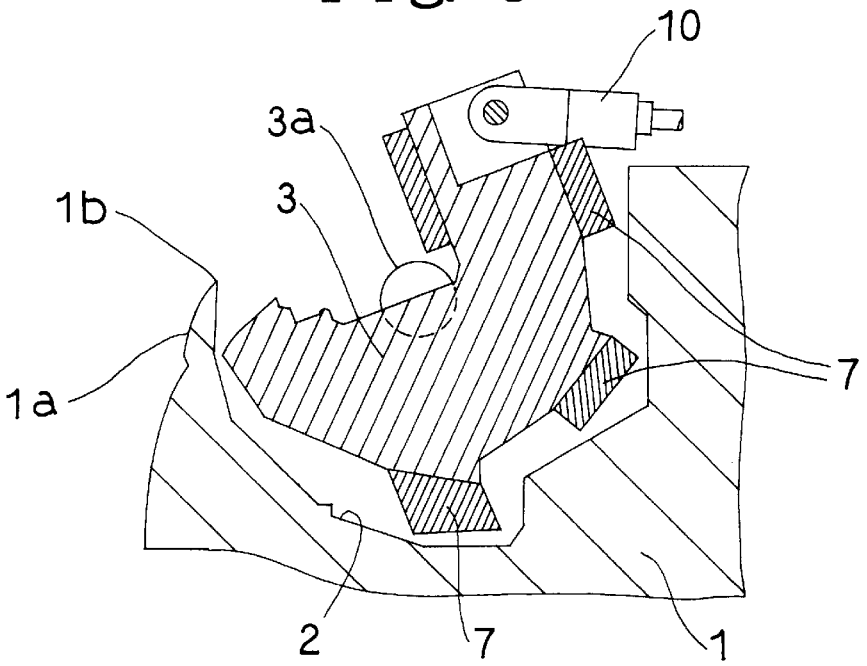
FIG. 8 is a longitudinal section for showing a substantial part to indicate a preferred embodiment in which a protrusion step part is arranged at a rotary die.
Figure 9:
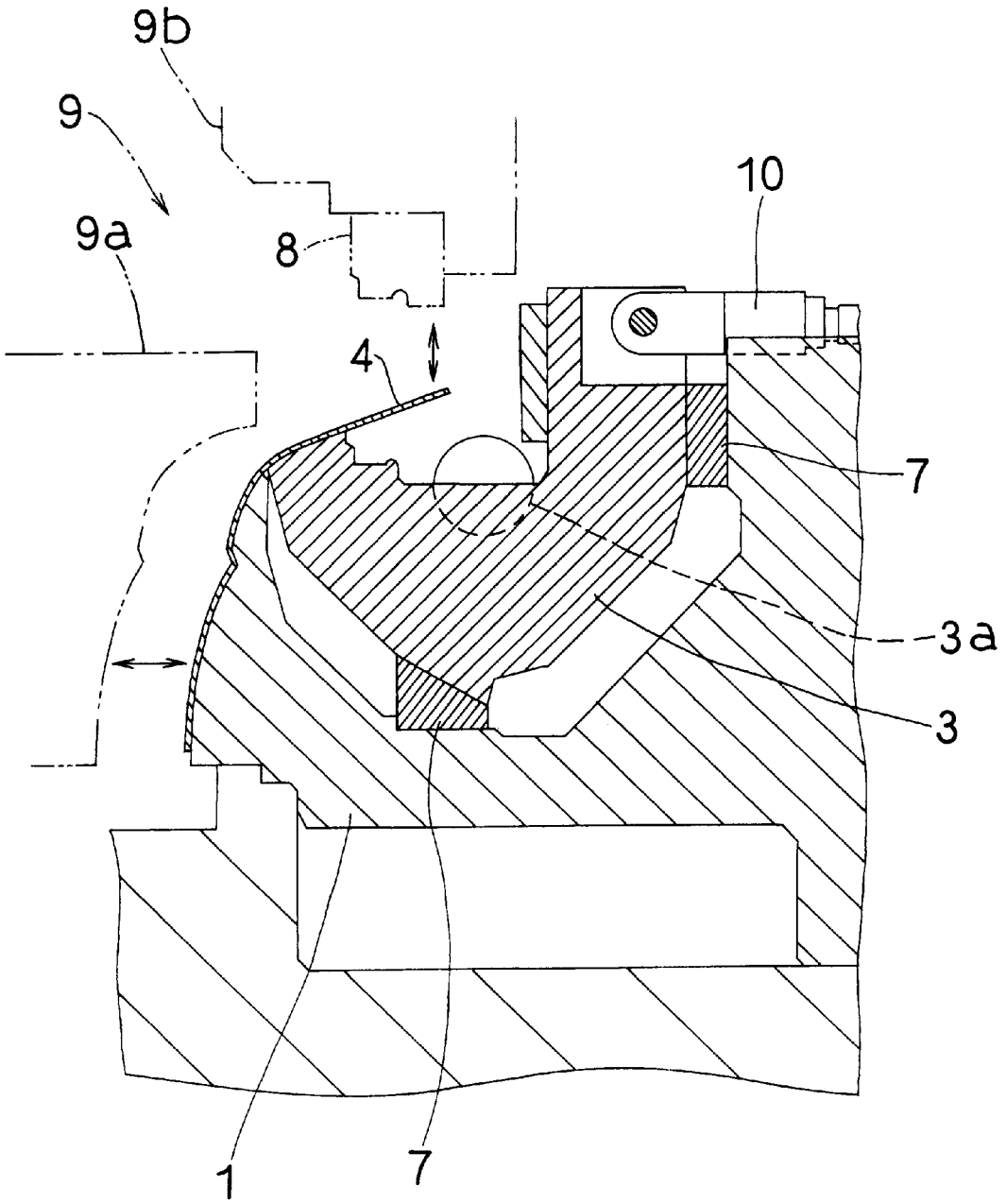
FIG. 9 is a longitudinal section for showing a substantial part to indicate another arrangement of a protrusion step part.

With the foregoing, a forming method, a forming position and the number of formation of the protrusion steps 7 and a shape of the receiving surface 7*a* in the present invention are optional. Accordingly, it is satisfactory that the protrusion steps 7 may be one in which they may be cut and machined concurrently when the cavity 2 is machined at the lower die 1, for example. In addition, in the case of the present invention, it is satisfactory that the protrusion steps 7 may be one in which they may be formed at positions where the rotary die 3 can be supported and so, as shown in FIG. 7, it is satisfactory that the protrusion steps may be one in which they are displaced from just below the gathering and bending blade 8 to a rightward side as viewed in the figure.

In addition, the present invention is not limited to such a case that the protrusion steps 7 are formed at the inner circumferential surface of the cavity 2. That is, in the case of the present invention, it is satisfactory that the protrusion steps 7 may be formed at the outer circumferential surface position 3*b* of the rotary die 3 opposing against the inner circumferential surface of the cavity 2.

In addition, in the case of the present invention, the driving device 10 may be constituted by a motor or a hydraulic cylinder or the like.

What is claimed is:

1. A bending die comprising a lower die having a groove-like cavity formed at its upper surface, the cavity having an inner circumferential surface; a rotary die supported in the cavity of the lower die at both ends thereof by a shaft and rotatably stored in it; an upper die arranged above the rotary die; and a driving device for rotating said rotary die in a downward direction after the upper die is opened and for retracting it, wherein the inner circumferential surface of the cavity at said lower die is formed with some protrusion steps for use in supporting the rotary die when pressing operation is carried out, the protrusion steps being formed into flat surfaces;

the upper surface of said rotary die is formed with a forming part for use in gathering and bending a metallic plate to be extended in a longitudinal direction of the rotary die;

said upper die is formed with a gathering and bending blade to be fitted to the forming part of the rotary die; and the rotary die is supported by the protrusion steps while the outer edge of the forming part is being abutted against the upper edge of the lower die when pressed, and after pressing operation, the rotary die is rotated in a downward direction by said driving device.

2. A bending die according to claim 1, wherein the protrusion steps are formed in separate from the lower die and fixed to the inner circumferential surface of the cavity.

3. A bending die according to claim 1, wherein the protrusion steps are formed by cutting and machining together with the cavity.

4. A bending die according to claim 1, wherein the protrusion steps are formed continuously in a longitudinal direction of the cavity.

5. A bending die according to claim 1, wherein the protrusion steps are formed intermittently in a longitudinal direction of the cavity.

6. A bending die according to claim 1, wherein the protrusion steps are formed at a position opposing against the gathering and bending blade of the upper die, a position opposing against the rear surface of the rotary die and an intermediate position between these both positions.

7. A bending die according to claim 1, wherein the protrusion steps are formed at a position opposing against the gathering and bending blade of the upper die and a position opposing against the rear surface of the rotary die.

8. A bending die according to claim 1, wherein the protrusion steps are formed at the outer circumferential surface of the rotary die opposing against the inner circumferential surface of the cavity in place forming the protrusion steps at the inner circumferential surface of the cavity.

9. A bending die according to claim 1, wherein the driving device is constituted by an air cylinder and the extremity end of a rod of the air cylinder is rotatably attached to a rising part of the rear surface of the rotary die.

* * * * *